United States Patent [19]

Jack et al.

[11] 3,958,145

[45] May 18, 1976

[54] HIGH PRESSURE, MERCURY VAPOR, METAL HALIDE DISCHARGE LAMP

[75] Inventors: Alexander Gray Jack; Wiggert Kroontje, both of Eindhoven, Netherlands

[73] Assignee: U.S. Philips Corporation, New York, N.Y.

[22] Filed: Feb. 14, 1974

[21] Appl. No.: 442,654

[30] Foreign Application Priority Data

Mar. 6, 1973 Netherlands ..... 7303079

[52] U.S. Cl. ..... 313/184; 313/225; 313/229

[51] Int. Cl.[2] ..... H01J 61/20; H01J 61/22

[58] Field of Search ..... 313/184, 229, 225

[56] References Cited

UNITED STATES PATENTS

| | | | |
|---|---|---|---|
| 3,234,421 | 2/1966 | Reiling | 313/225 X |
| 3,279,877 | 10/1966 | Smith et al. | 313/229 X |
| 3,431,447 | 3/1969 | Larson | 313/229 X |
| 3,566,178 | 2/1971 | Mori et al. | 313/229 |
| 3,586,898 | 6/1971 | Speros et al. | 313/229 |
| 3,639,801 | 2/1972 | Jacobs et al. | 313/229 X |
| 3,781,586 | 12/1973 | Johnson | 313/229 X |

*Primary Examiner*—Palmer C. Demeo
*Attorney, Agent, or Firm*—Frank R. Trifari

[57] ABSTRACT

A high pressure mercury vapour discharge lamp having a discharge vessel provided with electrodes between which the discharge is maintained during operation and comprising a quantity of rare gas as a starting gas and furthermore between 0.5 and 25 mg of mercury and between 1 and 20 $\mu$g mol of at least one of the halides of tin (with the exception of fluoride) per cubic cm of contents of the discharge vessel. To decrease the colour temperature of the radiation emitted by the lamp the discharge vessel is furthermore provided with at least one of the halides of lithium (with the exception of fluoride), while up to a maximum of 50 mol % of lithium halide may be replaced by sodium halide.

12 Claims, 2 Drawing Figures

HIGH PRESSURE, MERCURY VAPOR, METAL HALIDE DISCHARGE LAMP

Figure 1:
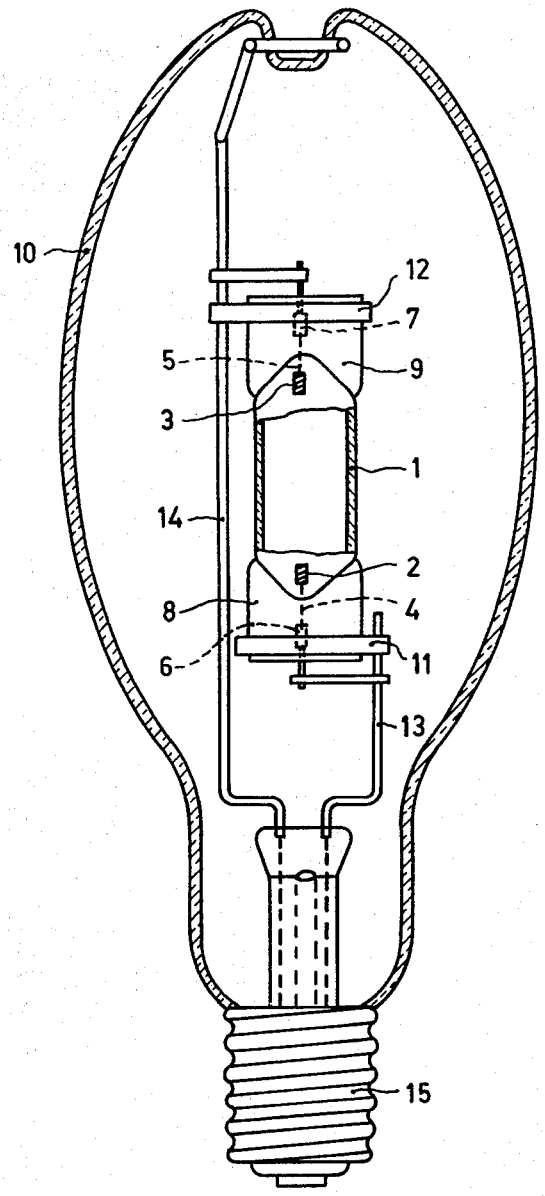

The invention relates to a high pressure mercury vapour discharge lamp comprising a discharge vessel and provided with electrodes between which the discharge is maintained during operation, and containing a quantity of rare gas as a starting gas and furthermore between 0.5 and 25 mg of mercury and between 1 and 30 $\mu$g mol of at least one of the halides of tin (with the exception of fluoride) per cubic cm of contents of the discharge vessel.

High pressure mercury vapour discharge lamps have been known for a long time as efficient light sources having a high intensity. They are used in large numbers, for example, for street lighting, lighting of factories and the like. A drawback of these lamps is that the spectral distribution of the emitted visible radiation mainly consists of lines in the green and yellow regions of the spectrum so that a poor colour rendition is obtained with these lamps. An improvement of both the colour rendition and the efficiency of the high pressure mercury vapour discharge lamp is possible by adding in addition to mercury one or more metal halides to the lamp filling (see U.S. Pat. Spec. No. 3,234,421). A combination of metal halides which is frequently used in practice is sodium iodide, thallium iodide and indium iodide. The spectral distribution of the radiation emitted by these lamps mainly consists of lines originating from the added metals, which lines are found inter alia over the entire visible part of the spectrum. When strict requirements are imposed on colour rendition, for example, in case of interior lighting the said metal halide-containing lamps are less suitable because a continuous spectral distribution of the radiation emitted by the lamp is then required.

High pressure mercury vapour discharge lamps which in addition to mercury comprise tin halides, notably tin chloride and tin iodide are known from German Pat. application No. 2,023,770. The radiation emitted by these lamps mainly originates from tin halide molecules and has a very broad continuous spectral distribution. As a result of this continuous spectral distribution the colour rendition of these lamps is very satisfactory. Generally values of the colour rendering index $R_a$ (mean value of the rendition indices for 8 test colours as defined by the Commission Internationale d'Eclairage) of up to approximately 85 are achieved. The radiation efficiency of these lamps and also the colour temperature of the emitted radiation are dependent on the chlorine-iodine ratio used. High efficiencies, for example, 60 lm/W and high colour temperatures, for example 6000 K are obtained at high values of the said chlorine-iodine ratio. For many practical uses, for example, for interior lighting considerably lower values of the colour temperature, for example, 4000K or less, are desired. This may be partly achieved with the known lamps by choosing the chlorine-iodine ratio to be low. This has, however, the drawback that the radiation efficiency then becomes inadmissibly low.

Tin halide-containing high pressure mercury vapour discharge lamps are furthermore known from Netherlands Pat. application No. 6610396. This application particularly describes lamps which comprise tin bromide and tin iodide. These lamps too have the drawback that a high radiation efficiency is accompanied by a high colour temperature (nemely at high values of the bromine-iodine ratio).

The object of the invention is to provide tin halide-comprising high pressure mercury vapour discharge lamps which have a low colour temperature of the emitted radiation while retaining a high radiation efficiency and a satisfactory colour rendition.

According to the invention a high pressure mercury vapour discharge lamp has a discharged vessel provided with electrodes between which the discharge is maintained during operation and comprising a quantity of rare gas as a starting gas and furthermore between 0.5 and 25 mg of mercury and between 1 and 30 $\mu$g mol of at least one of the halides of tin (with the exception of fluoride) per cublic cm of contents of the discharge vessel and is characterized in that the discharge vessel comprises at least one of the halides of lithium (with the exception of fluoride) in a quantity which is effective for decreasing the colour temperature of the radiation emitted by the lamp while up to a maximum of 50 mol % of lithium halide may be replaced by sodium halide.

A lamp according to the invention has a discharge vessel of light permeable material, for example, quartz. Electrodes between which the discharge takes place during operation are provided in the discharge vessel. To ignite the lamp easily the discharge vessel is filled with a small quantity of a starting gas consisting of one or more rare gases, for example, up to a pressure of several to some dozen Torr. The discharge vessel is furthermore provided with a quantity of mercury which completely evaporates in the operating condition and with at least one tin halide. To obtain a high pressure mercury vapour discharge the quantity of mercury is to be chosen between 0.5 and 25 mg per cubic cm of contents of the discharge vesel. One or more of the compounds tin chloride, tin bromide and tin iodide may be used as a tin halide. Tin fluoride is not suitable due to its great aggressiveness. Tin halide is used in a quantity of between 1 and 30 $\mu$g mol per cubic cm. When the lamp comprises less than the said minimum quantity of tin halide the contribution of continuous tin halide radiation to the radiation emitted by the lamp is too low; when using more than 30 $\mu$g mol of tin halide per cubic cm an unstable operating lamp is obtained in case of a vertical operating position.

It was found that the colour temperature of the radiation emitted by the lamp can be considerably decreased when furthermore lithium halide and/or sodium halide is added to the lamp filling. The favourable radiation efficiency of the lamp is then maintained. Chlorides, bromides and iodides (the fluorides are again excluded) are suitable as halides of lithium and/or sodium. It has been found that an unwanted decrease of the colour rendering index is obtained when sodium halide only is used. For this reason lithium halide or lithium halide replaced up to a maximum of 50 mol % by sodium halide is used in a lamp according to the invention. If the number of sodium halide molecules in the lamp is not larger than the number of lithium halide molecules the unfavourable influence of sodium halide on the colour rendering index is only slight and therefore acceptable.

Due to the addition of lithium halide and optionally sodium halide to the lamp according to the invention the continuous tin halide spectrum is completed with the characteristic lithium emission at approximately 610 and 671 nm and optionally the characteristic sodium emission at approximately 590 nm. This completion of the spectrum results in the desired decrease of the colour temperature of the radiation.

A considerable decrease of the colour temperature, for example, a decrease by several hundred degrees Kelvin is already achieved with very slight quantities of lithium halide (optionally partly replaced by sodium halide). Since such very slight quantities of halide can easily disappear during operation of the lamp these halides are preferably used in an excess so that always unevaporated halide is present during operation of the 1 amp. To does the lithium and optionally sodium halide easily in the lamp a large excess is preferably used in practice, for example, 0.1 to 20 $\mu$g mol per cubic cm of contents of the discharge vessel.

The above-mentioned components of the lamp filling mercury, tin halide, lithium halide and optionally sodium halide may be provided as such in the discharge vessel. It is alternatively possible to provide one or more of the tin-bound halogens entirely or partly as mercury halide. In addition elementary tin is to be dosed which reacts in the lamp with the halogen originating from mercury halide to form tin halide. In practice an excess of tin is frequently chosen because then the thermodynamic stability of the lamp filling is enhanced. The excess of tin furthermore has no influence on the properties of the lamp. If part of halogen is added as mercury halide this is of course to be taken into account for the dosage of mercury.

If only tin iodide is present as a tin halide in a lamp according to the invention both chloride and bromide and iodide may be chosen for lithium halide. In these cases the original tin iodide spectrum remains unchanged due to the lithium halide addition and is only completed with lithium radiation in the manner described above. If a lamp according to the invention comprises tin bromide optionally in addition to tin iodide the use of lithium chloride and/or lithium bromide is preferred. The use of lithium iodide may in this case have the result that the reaction $SnBr_2 + 2LiJ \rightarrow SnJ_2 + 2LiBr$ proceeds to the right to a greater or lesser extent so that the bromine-iodine ratio of the tin halides present in the lamp is changed in an unreproducible manner. A variation of the said ratio gives rrise to a modification of the original tin halide spectrum and generally also to a decrease of the radiation efficiency. For analogous reasons only lithium chloride is used preferably as a lithium halide in a lamp according to the invention which comprises tin chloride optionally in addition to tin iodide and tin bromide. For sodium halide to be used optionally the above-mentioned halogens mentioned for lithium halide are preferred for the same reason. In summary it can be stated that in order to obtain reproducible lamps these lamps according to the invention are preferred in which the halogens bound with lithium and sodium have an atomic number which is equal to or smaller than the atomic number of the tin-bound halogen present in the lamp and having the lowest atomic number.

It has been found that when adding only lithium halide to a tin halide-comprising lamp, a considerable increase of the colouring rendering index is obtained in addition to a decrease of the colour temperature for a substantially constant radiation efficiency. Consequently lamps according to the invention are preferred in which exclusively lithium halide is used for decreasing the colour temperature of the emitted radiation.

A special advantage of the lamps according to the invention is that the chromaticity point of the radiation emitted by the lamps is slightly shifted relative to the chromaticity point of the known lamps which do not comprise lithium or sodium halide. The said shift of the chromaticity point is such that the lamps according to the invention, as compared with the known lamps, have a better colour aspect.

One embodiment of a lamp according to the invention which is preferred comprises tin chloride, tin iodide and optionally an excess of tin in addition to mercury and a rare gas analogous to the lamps known from German Pat. application No. 2,023,770. In this case the halogen-tin ratio is chosen to be between 0.1 and 2.5 and the chlorine-iodine ratio is chosen to be between 0.25 and 4. This preferred embodiment furthermore comprises lithium chloride in a quantity of between 0.1 and 20 $\mu$g mol per cubic cm of contents of the discharge vessel. A very advantageous combination of a high radiation efficiency, a very satisfactory colour rendition, a low colour temperature and a satisfactory colour aspect can be obtained with these lamps.

A further preferred embodiment of a lamp according to the invention comprises tin bromide, tin iodide and optionally an excess of tin in addition to mercury and a rare gas as in the lamps known from Netherlands Pat. Application No. 6610396. The halogen-tin ration is chosen to be between 0.1 and 2.5 and the bromine-iodine ratio is chosen to be between 0.1 and 5. According to the invention this lamp furthermore comprises lithium chloride and/or lithium bromide in a quantity of between 0.1 and 20 $\mu$g mol per cubic cm of contents of the discharge vessel. In addition to a high radiation efficiency, a satisfactory colour rendition, a satisfactory colour aspect and a low colour temperature is achieved with these lamps.

The invention will now be described in greater detail with reference to a drawing and a number of examples and measurements.

Figure 2:
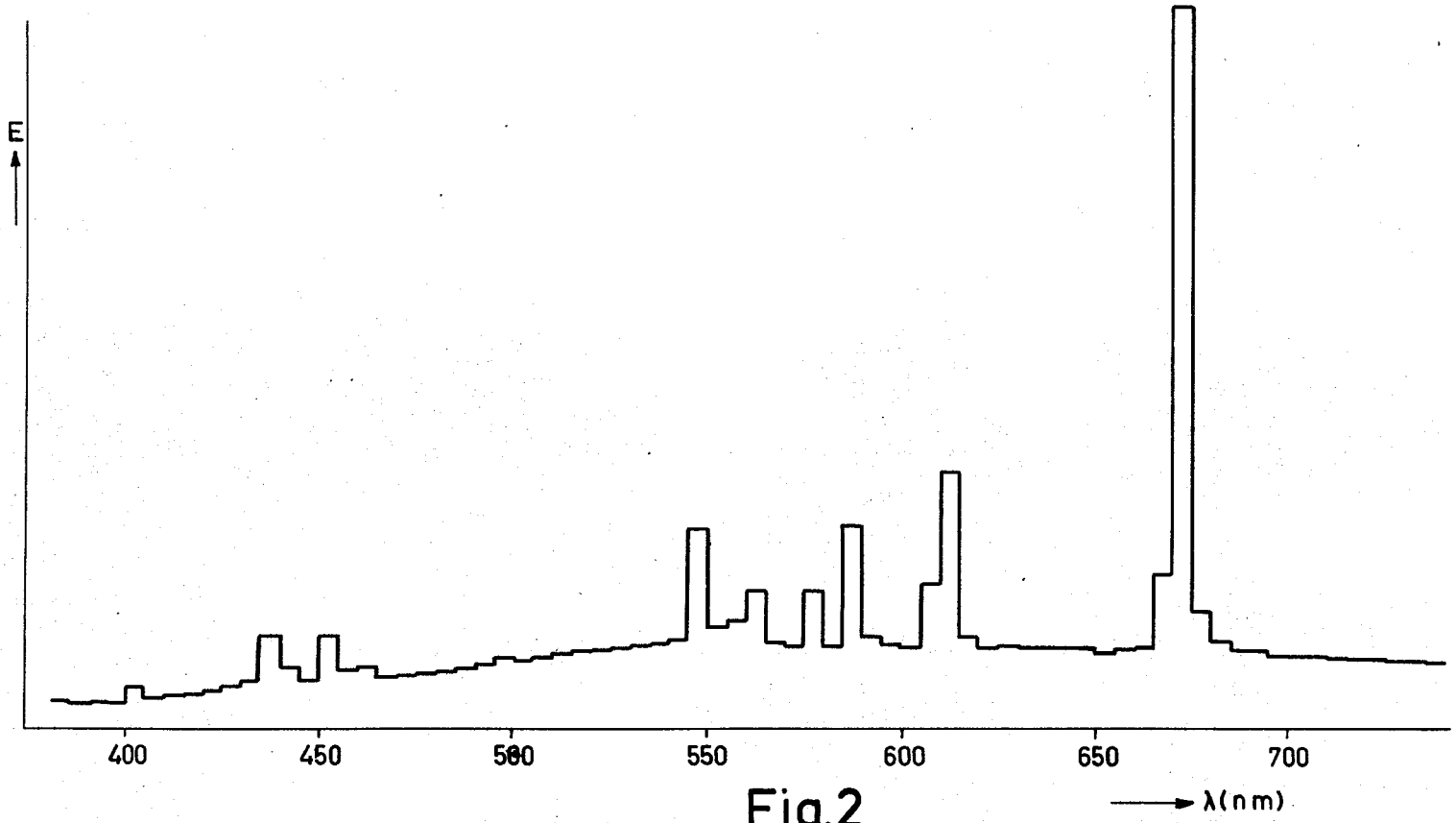

In the drawing:

FIG. 1 shows an embodiment of a high pressure mercury vapour discharge lamp according to the invention and FIG. 2 shows the spectral energy distribution of the radiation emitted by a lamp according to the invention.

In FIG. 1, 1 is the tubular quartz glass discharge vessel of a lamp according to the invention. Tungsten electrodes 2 and 3 are provided at the ends of the tube 1. The electrodes are supported by current supply wires 4 and 5 which are passed in a vacuum-tight manner through the pinches 8 and 9 by means of molybdenum foils 6 and 7, respectively. The tube 1 is suspended in a glass outer envelope 10 by means of metal strips 11 and 12 which clamp about the pinches 8 and 9 and are secured to the supporting terminals 13 and 14, respectively, which also serve as current supply members for the electrodes 2 and 3, respectively. The current supply members 13 and 14 passed in a vacuum-tight manner through the outer envelope 10 and are connected to the contacts of the lamp cap 15. The internal diameter of the tube 1 is approximately 20 mm and its contents are approximately 16 cubic cm. The distance between the electrodes 2 and 3 is approximately 40 mm. The lamp is intended for a load of 400 W.

EXAMPLE 1.

The discharge tube of a lamp as shown in FIG. 1 was filled with argon to a pressure of 30 Torr (at room temperature) and furthermore with 45 mg Hg
16 mg $HgI_2 + HgCl_2$ (ratio I/Cl = 2)
8 mg Sn
2 mg LiCl The measurements on this lamp (at a load of 400 W) were radiation efficiency $\eta = 60$ lm/W
colour temperature $T_c = 3780$ K
colour rendering index $R_a = 91$
Chromaticity point $(x ; y) = (0.391; 0.387)$.

A lamp which does not comprise LiCl but is furthermore completely identical to the above described lamp according to the invention yielded the following measuring results:

$\eta = 60$ lm/W
$T_c = 4620$ K
$R_a = 84$
$(x;y) = (0.362; 0.392$

EXAMPLE 2

A lamp according to the invention having a construction completely analogous to that of the lamp of FIG. 1 was provided with a discharge tube whose internal diameter was approximately 15 mm and its volume was approximtaly 7 cubic cm. The electrode distance is again approximately 40 mm. The discharge tube of this lamp was filled with a small quantity of rare gas and with:

19 mg Hg
0.5 mg $HgI_2 + HgCl_2$ (ratio I/Cl = 1)
4 mg Sn
1 mg LiCl.

The measurements on this lamp at a load of 400 W were:

$\eta = 60$ lm/W
$T_c = 4960$ K
$R_a = 88$
$(x;y) = (0.346; 0.353)$.

A lamp which does not comprise LiCl but is furthermore completely identical to the above-described lamp according to the invention yielded the following measuring results.

$\eta = 60$ lm/W
$T_c = 5900$ K
$R_a = 83$
$(x;y) = (0.323; 0.354)$.

The above clearly shows that the lamps according to the invention, as compared with the known lamps, yield a considerable decrease of the colour temperature while maintaining the favourable radiation efficiency. Furthermore a very advantageous increase of the colour rendering index and an improvement of the colour aspect can be obtained with the lamps according to the invention.

FIG. 2 of the drawing shows in a graph the spectral energy distribution of the lamp according to the invention of example 1. The wavelength $\lambda$ is plotted in nm on the horizontal axis and the radiation energy E per wavelength interval of 5 nm is plotted on the vertical axis. The graph shows that the emission spectrum of the lamp according to the invention consists of the tin halide continuum on which some mercury and tin lines are superimposed and which is completed with lithium radiation at 610 and 671 nm. The emission spectrum shows that the lamp also comprises a little sodium which is introduced as an impurity into the lamp (emission at 590 nm).

What is claimed is:

1. A high pressure mercury vapour discharge lamp having a discharge vessel provided with electrodes between which the discharge is maintained during operation and comprising a quantity of rare gas as a starting gas and furthermore between 0.5 and 25 mg of mercury and between 1 and 30 $\mu$g mol of at least one of the halides of tin per cubic cm of contents of the discharge vessel, wherein the contents of the discharge vessel comprises at least one of the halides of lithium.

2. A high pressure mercury vapour discharge lamp as claimed in claim 1, the wherein said lithium bound halogens have an atomic number which is smaller than or equal to the atomic number of the tin-bound halogen having the lowest atomic number.

3. A high pressure mercury vapour discharge lamp as claimed in claim 2, which lamp comprises tin chloride, tin iodide in which the halogen-tin ratio has a value of between 0.1 and 2.5 and the chlorine-iodine ratio has a value of between 0.25 and 4, wherein the contents of said discharge vessel comprises lithium chloride in a quantity of between 0.1 and 20 $\mu$g mol per cubic cm of contents of the discharge vessel.

4. A lamp as described in claim 3 further incuding an excess of tin in said vessel.

5. A high pressure mercury vapour discharge lamp as claimed in claim 2, which lamp comprises tin bromide, tin iodide in which the halogen-tin ratio has a value of between 0.1 and 2.5 and the bromine-iodine ratio has a value of between 0.1 and 5, characterized in that the contents of said discharge vessel comprises lithium chloride and/or lithium bromide in a quantity of between 0.1 and 20 $\mu$g mol per cubic cm of contents of the discharge vessel.

6. A lamp as described in claim 5 further including an excess of tin in said vessel.

7. A lamp as described in claim 1 wherein said discharge vessel contents further include a sodium halide in a molar quantity not more than the molar quantity of said lithium halide.

8. A high pressure mercury vapour discharge lamp as claimed in claim 7 wherein said lithium and sodium-bound halogens have an atomic number which is smaller than or equal to the atomic number of the tin-bound halogen having the lowest atomic number.

9. A high pressure mercury vapour discharge lamp as claimed in claim 8, said discharge vessel contents comprising tin chloride and tin iodide in which the halogen-tin ratio has a value of between 0.1 and 2.5 and the chlorine-iodine ratio has a value of between 0.25 and 4, wherein the contents of said discharge vessel comprises lithium chloride in a quantity of between 0.1 and 20 $\mu$g mol per cubic cm of said contents of the discharge vessel.

10. The lamp as claimed in claim 9 wherein said discharge vessel contents comprises an excess of tin.

11. A high pressure mercury vapour discharge lamp as claimed in claim 7, which lamp comprises tin bromide and tin iodide in which the halogen-tin ratio has a value of between 0.1 and 5, wherein the contents of said discharge vessel comprises one or more ingredients selected from the group consisting of lithium chloride and lithium bromide in a quantity of between 0.1 and 20 $\mu$g mole per cubic cm of contents of the discharge vessel.

12. The lamp as described in claim 11 wherein the contents of said vessel further includes an excess of tin.

* * * * *